US005904246A

United States Patent [19]

Weisburn et al.

[11] Patent Number: 5,904,246

[45] Date of Patent: May 18, 1999

[54] MAGNETIC LOCKING MECHANISM FOR A SECURITY PACKAGE

[75] Inventors: James T. Weisburn, Massillon, Ohio; Matthew P. Williams, Jamestown, N.C.; Nicholas M. Sedon, Massillon, Ohio; Dennis D. Belden, Jr.; James A. McGill, both of Canton, Ohio

[73] Assignee: Alpha Enterprises, Inc., North Canton, Ohio

[21] Appl. No.: 09/024,330

[22] Filed: Feb. 17, 1998

Related U.S. Application Data

[63] Continuation-in-part of application No. 08/857,964, May 16, 1997, Pat. No. 5,782,350

[60] Provisional application No. 60/038,629, Feb. 19, 1997.

[51] Int. Cl.[6] ..... B65D 85/57

[52] U.S. Cl. ..... 206/308.2; 206/1.5; 206/807; 206/818

[58] Field of Search ..... 206/1.5, 308.2, 206/387.11, 807, 818; 70/63

[56] References Cited

U.S. PATENT DOCUMENTS

| | | | |
|---|---|---|---|
| 767,298 | 8/1904 | Louis . | |
| 971,423 | 9/1910 | Walters . | |
| 3,933,240 | 1/1976 | Humble | 206/1.5 |
| 4,466,540 | 8/1984 | Lotrous et al. | 206/387 |
| 4,727,984 | 3/1988 | Bennardo | 206/1.5 |
| 4,966,020 | 10/1990 | Fotheringham et al. | 70/276 |
| 5,031,756 | 7/1991 | Buzzard et al. | 206/1.5 |
| 5,147,034 | 9/1992 | Broadhead et al. | 206/1.5 |
| 5,209,086 | 5/1993 | Bruhwiler | 70/57.1 |
| 5,211,283 | 5/1993 | Weisburn et al. | 206/1.5 |
| 5,289,914 | 3/1994 | Holmgren | 206/1.5 |
| 5,390,515 | 2/1995 | Essick | 70/63 |
| 5,524,752 | 6/1996 | Mazzucchelli | 206/308.2 |
| 5,588,315 | 12/1996 | Holmgren | 70/57.1 |
| 5,598,728 | 2/1997 | Lax | 70/276 |
| 5,713,461 | 2/1998 | Su | 206/303 |

*Primary Examiner*—Jim Foster
*Attorney, Agent, or Firm*—Sand & Sebolt

[57] ABSTRACT

A reusable plastic package for securely holding and displaying a rectangular article such as a compact disc includes a housing having large and small compartments formed on opposite ends for selectively storing an article in the larger of the compartments. The large compartment has an access opening for inserting and removing the article into and out of the compartment. The small compartment functions as a lock compartment whereby a lock plate is slidably mounted thereon and selectively movable across a portion of the access opening of the larger storage compartment for releasably securing the article in the larger storage compartment. Magnetically releasable locking levers are formed within the lock compartment and interengage with mating projections formed on the lock plate when the lock plate is in a selected locked position for securing the article within the package due to a portion of the lock plate blocking the access opening. Resilient arms hold the locking levers in the locked position until deflected by key. The key first deflects the arm and then disengages the locking levers from the projections to enable the lock plate to be moved to the unlocked position. The locking levers and projections are spaced apart in groups in the locking compartment and on the lock plate to provide space for an electronic article surveillance tag.

23 Claims, 10 Drawing Sheets

MAGNETIC LOCKING MECHANISM FOR A SECURITY PACKAGE

CROSS-REFERENCE TO RELATED APPLICATION

This application claims the benefit of U.S. Provisional Application Ser. No. 60/038,629, filed Feb. 19, 1997, and is a Continuation-in-Part Application of pending application Ser. No. 08/857,964, filed May 16, 1997 U.S. Pat. No. 5,782,350.

BACKGROUND OF THE INVENTION

1. Technical Field

The invention relates to security packages and in particular to a security package for securely holding and displaying a rectangular-shaped article such as a storage box for recorded media. Specifically, the invention relates to a reusable security package for holding and displaying recorded media and its storage container such as compact discs within jewel boxes, having a magnetic lock which when in a locked position prevents unauthorized removal of the article from within the security package.

2. Background Information

In recent years, recorded media such as audio cassettes, compact discs, digital audio tapes, and mini discs (MD) have become increasingly popular, almost entirely replacing record discs and 8-track audio tapes. Specifically, compact discs (CDs) are growing most rapidly in popularity with rapidly increasing sales of compact disc players. These compact discs are thin flexible plastic resin sheets with a digitally recorded engraved pattern and resemble small vinyl photograph records and are operated by a laser enclosed in a compact disc player. Since the compact discs are relatively small, very thin, and are usually far more expensive than the heretofore used audio tapes and 8-track tapes, CDs are more susceptible to theft when displayed for sale in a retail store outlet.

The introduction of these recorded media into the marketplace presents a problem to the retailer sellers in that these recorded media are considerably smaller than the heretofore used record discs and 8-track tapes, but still have to be displayed so that prospective purchasers can inspect the same to determine the artist, songs, etc. on the recorded media. This presents a security problem due to the extremely small size of the recorded media.

Therefore, it has become important that the recorded media, which are usually contained within their own storage container or box, such as a jewel box for compact discs, be repackaged in an outer security package to prevent their theft from the display cases used in most retail businesses. Since the compact discs generally are retained within a plastic box commonly referred to as a "jewel box" to protect the disc from scratching and damage and to provide a protective storage container for the disc when not in use, it is desirable that these plastic storage boxes be retained in the larger package for display to prevent theft of the smaller plastic storage box containing the CD. Various types of housings and security packages have been developed to provide a safe and secure device for displaying the CDs within jewel boxes while retarding unauthorized removal of the CD from the display package and subsequent theft from the store. Various prior art display and security containers are shown in U.S. Pat. Nos. 3,871,516, 4,285,429, 4,381,836, 4,589,549, 4,759,442, 4,760,914, 4,805,769, 4,834,238, 4,881,645, 4,951,814, 5,205,401, 5,211,283, and 5,460,266.

Although these prior art security packages for the various types of cassettes and recorded media have proven satisfactory for many applications, they present various problems, that is, the prior art security devices are bulky, complicated, difficult and time consuming to use or lock/unlock, too thick in relation to the cases that house the cassettes or CDs, not secure enough when locked, expensive and/or time consuming to manufacture. Also, most of these prior art security packages require a manually operated key having a plurality of tangs for releasing the locking mechanism at the retail store for removing the CD and jewel box therefrom enabling the security package to be reused by the store. Some of these keys have sharp tangs which could injure the store clerk, or flat tangs requiring a larger access opening to the lock mechanism, thereby making the security package more susceptible to unauthorized tampering.

Therefore, the need exists for an improved security package forvarious types of recorded media such as CDs in which the recorded media are maintained in their usual display boxes for standard display yet protected from theft. In addition, a need exists for an improved security package for various types of recorded media which is absent mechanical locks which are often difficult to use, susceptible to breakage, and bulky, and which eliminates the need to use the usual key having the outwardly projecting tangs as the unlocking mechanism.

SUMMARY OF THE INVENTION

Objectives of the invention include providing an improved security package which can be mass produced relatively inexpensively as a two-piece molded plastic member, one piece of which forms the main housing and the other piece being a lock or slide plate slidably or pivotally mounted on the housing for securing a rectangular-shaped article in a storage compartment where the improved security package is slim in depth, preferably comparable to the depth of a jewel case, inexpensive and easy to both make and use, and designed for repeated reuse, and which can be manually loaded by retail shop personnel for subsequent sale, and which can be unloaded easily at the point of sale.

Another objective of the invention is to provide such a security package in which printed information on the stored article, and specifically on the large front or back face of the jewel case, is visible through enlarged openings formed in the walls of the housing which form the storage compartments.

Another objective of the invention is to provide such a security package in which the article to be stored is slid easily into the storage compartment and secured therein by the easily operated lock plate which is selectively moved over the access opening of the storage compartment to prevent unauthorized removal of the article from within the storage compartment, and magnetically actuated to disengage to allow removal of the article.

Another objective of the invention is to provide such a security package in which an inexpensive magnetic key unlocks a magnetically actuated lock plate from the housing, whereby the lock plate can be moved to an unlocked position permitting the stored article to be manually removed from the storage compartment upon completion of a sale, enabling the package to be reused for storing another article for sale.

Another objective is to provide such a package which can be molded of rugged plastic material and repeatedly reused, thereby reducing the cost to a manufacturer and/or distributor of the articles to be stored therein, such as audio cassettes, compact discs, etc.

Another objective of the invention is to provide a security package which includes mechanically actuated locking arms that must be deflected to an unlocked position before a magnetic key may move a magnetically actuated lock plate to an unlocked position whereby the stored article may be manually removed from the storage compartment.

Another objective of the invention is to provide such a security package in which an end of the lock plate opposite of a locking edge is aligned with an end wall of a housing having a lock compartment therein when the plate is in a locked position, preventing the formation of a lip which could be grasped to enable the lock plate to be pried from the housing to steal a stored article from the package.

Another objective of the invention is to provide such a security package in which magnetic locking levers and projections are located within the lock compartment and lock plate, and are spaced apart in groups, thereby enabling another portion of the compartment to be void for the placement and storage of an electronic article surveillance tag therein, preferably in an inconspicuous manner, but in any case, to detect unauthorized removal of the security package with an article therein from the retail business.

Another objective is to provide such a security package in which the orienting tabs and grooves on the lock plate that secure the article when locked, are formed as part of the locking mechanism and prevent the locking mechanism from moving to the locked position unless the orienting tabs and grooves are received within openings and stops formed in the storage compartment to ensure that the article to be stored is properly oriented within the storage compartment of the security package.

Another objective of the invention includes providing an improved security package which enables the compact disc to remain in its usual display and storage package such as its jewel box in the case of a CD, which in turn is secured within the security package that retards theft of the compact disc.

Another objective of the invention is to provide such an improved security package which has an end portion thereof with a thickness generally equal to the thickness of the display package such as a jewel case containing the compact disc, which display package is secured within the security package, thereby enabling the security package to be mounted and displayed in display cases and racks heretofore only useable for the unsecured package, that is the jewel case, by positioning the security package in the display rack by the end of the package which has the same general shape and thickness of the jewel case contained therein.

Another objective of the invention is to provide an improved security package having a configuration that allows the front surface of one security package to nest with the rear surface of a next adjacent security package to decrease the shelf space occupied by the security package.

Another objective of the present invention includes providing an improved security package that permits the security packages to tilt with respect to each other while in a nested condition.

Another objective of the present invention includes providing an improved security package having a configuration that enables the package to be easily removed from between two other nested security packages.

Another objective of the invention is to provide such an improved security container which can be easily injection molded of various types of plastics in two components, namely, a housing and a lock plate, wherein the lock plate then is easily snap-fitted into position on the housing, thus providing for the economic manufacture and assemble of the security container.

Another objective of the invention is to provide such a security package which is of an extremely simple construction, which achieves the stated objectives in a simple, effective, an inexpensive manner, and which solves problems and satisfies needs in the art.

These and other objectives and advantages are obtained by the improved security package of the invention, the general nature of which may be stated as including a security package for holding and displaying a rectangular-shaped article including:

a) a housing having a rectangularly shaped storage compartment for selectively storing the article, said compartment having an access opening for inserting and removing the article into and out of said compartment;

b) a lock compartment formed adjacent the storage compartment;

c) a plate slidably or pivotally mountable on the lock compartment and selectively movable across at least a portion of the access opening of the storage compartment between locked and unlocked positions, for releasably securing said article in said storage compartment; and d) magnetically releasable lock means within one of said lock compartment and lock plate, the magnetically releasable lock means for selectively releasing the lock plate from the locked position when a magnetic field is proximate the magnetically releasable lock means.

Still other objectives and advantages of the present invention are obtained by the improved security package of the invention, the general nature of which may be stated as including a housing having a storage compartment for selectively storing the article, the compartment having an access opening for inserting and removing the article into and out of the compartment; a lock compartment formed adjacent the storage compartment; a lock plate moveably mountable with respect to the lock compartment and selectively movable across at least a portion of the access opening of the storage compartment between locked and unlocked positions for releasably security the article in the storage compartment; and first and second lock members within the lock compartment that cooperate to operatively engage with the lock plate for selectively securing the lock plate in the locked position and releasing the lock plate from the locked position, the first lock member being movable to a release position by an external actuator enabling the second lock member to release the lock plate when the second lock member is proximate a magnetic field.

BRIEF DESCRIPTION OF THE DRAWINGS

Preferred embodiments of the invention, illustrative of the best modes in which applicants have contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT(S)

Figure 1:
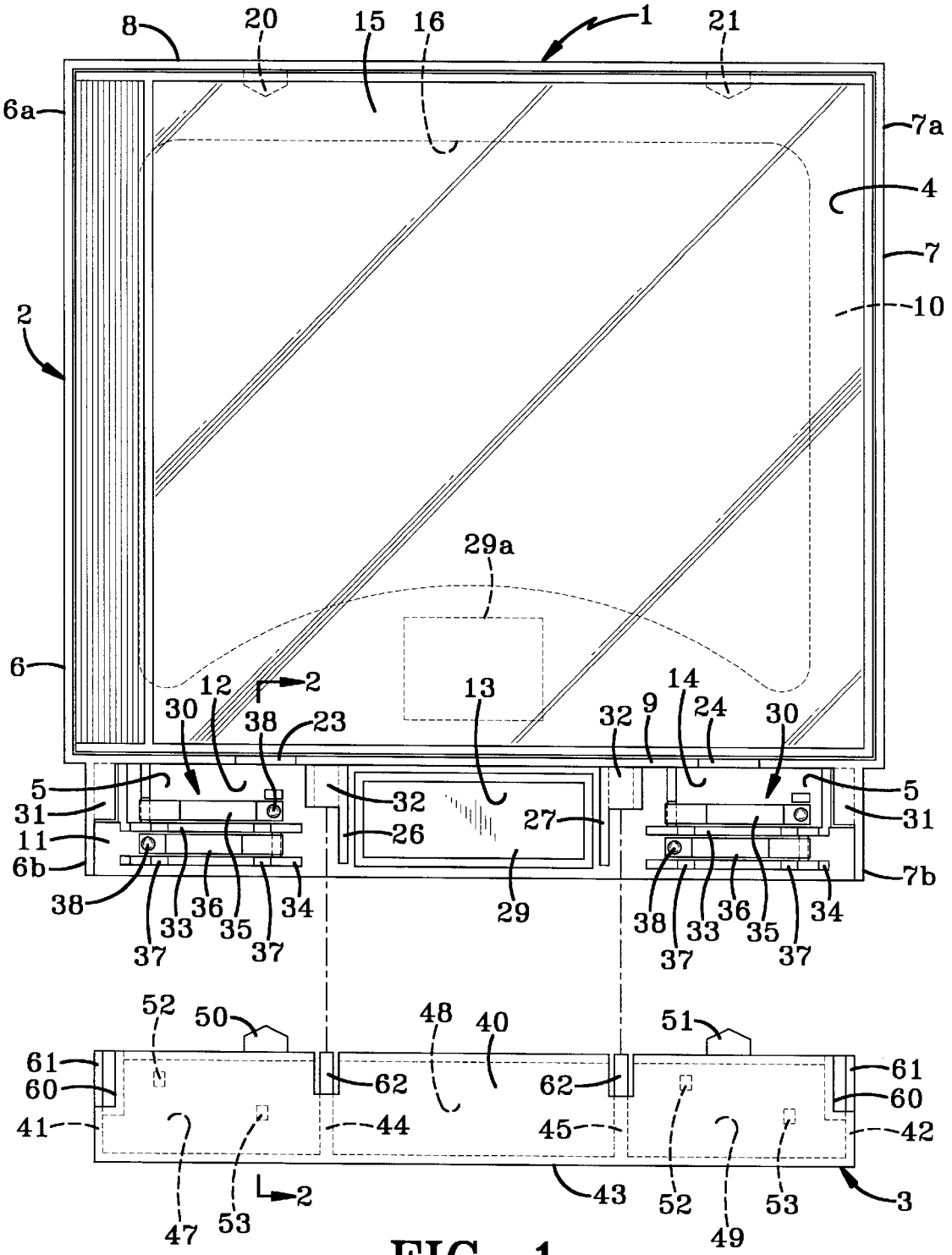
FIG. 1 is a top plan view of the security package with the locking slide plate removed therefrom.

The improved security package of the present invention is indicated generally at 1, and is shown particularly in FIG. 1. The security package 1 includes a main housing 2 and a slide or lock plate 3, where both housing 2 and lock plate 3 are each preferably formed as an integral one-piece plastic member, preferably of a high-impact polystyrene.

Security package 1 has a generally rectangular configuration with a generally slim depth substantially equivalent to that of a compact disc jewel case. The generally rectangular configuration of security package 1 is defined by a large storage compartment 4 and a small lock compartment 5. Overall, housing 2 includes a pair of longitudinally extending sidewalls 6 and 7 of a stepped construction which extend throughout the longitudinal length of housing 2, a pair of parallel end walls 8 and 9 which extend between and are perpendicular to sidewalls 6 and 7, and a pair of back walls 10 and 11 (as more clearly shown in FIGS. 2–4).

Storage compartment 4 is formed by storage sidewall 6*a* and 7*a*, end walls 8 and 9, and back wall 10. This resulting compartment 4 has four sides and a back face thereby providing a space in which a rectangular-shaped article 15, such as a compact disc, may be placed for storage through an open side or access opening opposite the back face which is wall 10. Wall 10 may further include one or more openings 16 preferably of smaller length and width than wall 10 and spaced inwardly apart from each of walls 6*a*, 7*a*, 8 and 9 whereby this opening 16 is provided so as to supply access to a back side of article 15 for more efficient removal of article 15 when lock plate 3 is not in the locked position as described below.

Storage compartment 4 further includes a pair of spaced apart tabs 20 and 21 extending inward from end wall 8 into storage compartment 4. Tabs 20 and 21 are preferably spaced apart from back wall 10 a distance either substantially equivalent or slightly equivalent to the depth distance of article 15, that is a depth distance of a standard compact disc jewel case when article is such. Tabs 20 and 21 may be of any geometrical configuration so long as each extends inward into storage compartment 4 so as to act as a lip for holding article 15 therein when article 15 is fully inserted within storage compartment 4, by either preferably inserting within corresponding slots in said article, or alternatively wrapping over said article. In the preferred embodiment, tabs 20 and 21 are either of a trapezoidal construction with two outermost points separated by a sloped face whereby one outermost point extends furthest into storage compartment 4, or as is shown in FIG. 1 of a semi-hexagonal shape where the hexagon is divided across the midpoint of two sides such that each tab has three outermost points extending inward into storage compartment whereby the center outermost point extends furthest therein. Storage compartment 4 also includes a pair of spaced apart notches 23 and 24 in end wall 9 where each notch extends inward from an outermost edge of end wall 9 opposite back wall 10.

Lock compartment 5 is formed by lock sidewalls 6*b* and 7*b*, end wall 9, and back wall 11. Lock compartment 5 is divided into three subcompartments 12, 13 and 14 by divider walls 26 and 27. Subcompartment 13 includes an electronic artificial surveillance (EAS) tag 29 (although the tag could alternatively be located in other locations such as at 29*a*), while subcompartments 12 and 14 include a locking mechanism 30. Subcompartments 12 and 14 each also include pry stops embodied in FIG. 1 as a planar stop 31 that is parallel to back wall 11 and spaced apart therefrom, and is integrally molded into sidewalls 6*b* and 7*b*, respectively. End wall 9, subcompartments 12 and 14 further include a stop 32 that is L-shaped with a parallel portion to back wall 11 that extends out from end wall 9 and divider walls 26 and 27, respectively, and is connected to a perpendicular portion to back wall 11 that extends from the parallel portion to back wall 11 and outward from end wall 9.

Each locking mechanism 30 includes a pair of access restriction walls 33 and 34 extending perpendicularly upward and spaced apart from back wall 11 as shown in FIGS. 1–4. Each of these access restriction walls 33 and 34 are spaced apart and extend transversely between one of lock sidewalls 6*b* and 7*b* and one of divider walls 26 and 27 within each of subcompartments 12 and 14. Each access restriction wall 33 and 34 includes a pair of cut-outs 37 for use during interaction of lock plate 3 with storage compartment 4. In accordance with the invention, each locking mechanism 30 includes a pair of metallic, resilient locking levers 35 and 36 that obliquely extend upward from back wall 11 in each subcompartment 12 and 14. In the embodiment shown in FIGS. 1–4, each pair of locking members 35 and 36 in each subcompartment 12 and 14 are spaced apart in a parallel arrangement while being fixed at opposite ends thereof. The slope of each lever 35 and 36 may be constant, or as shown in FIGS. 1, and 5–7, may include a flat region at the lever's connection end followed by an upwardly sloping region in its mid-section, and terminating in a relatively flat or less sloped termination end. This change in slope may be gradual or at distinct points as is shown in the figures. Each of the levers 35 and 36 are affixed to back wall 11 by any type of fastener or fastening means 38 which could be an adhesive, rivet, or any other device and/or method of fastening.

Each of these locking levers 35 and 36 is made of a metallic material susceptible to magnetic attraction and repulsion. Each of the locking levers is bent as described above so as to have a resting or natural position where the connection end is parallel to back wall 11, while the terminating end is parallel to a similar front wall 40 in lock plate 3, with the intermediate section sloping therebetween. This resting position is clearly shown in FIG. 6 and discussed in more detail subsequent hereto. Each of these locking levers 35 and 36 is flexible so as to flex out of this position whereby the terminating end is no longer parallel to and substantially adjacent to this front wall 40; however, when the force causing such flexing is removed, each locking lever 35 and 36 is resilient and returns to the resting position.

Lock plate 3 as is shown in FIG. 1 has front wall 40 terminating at opposing sides in sidewalls 41 and 42 and along a bottom edge in bottom wall 43. A pair of divider walls 44 and 45 extend from front wall 40 in a spaced apart and parallel manner between sidewalls 41 and 42 so as to divide lock plate 3 into three subcompartments 47, 48, and 49 of similar dimension to the subcompartments 12–14 of compartment 5.

Figure 3:
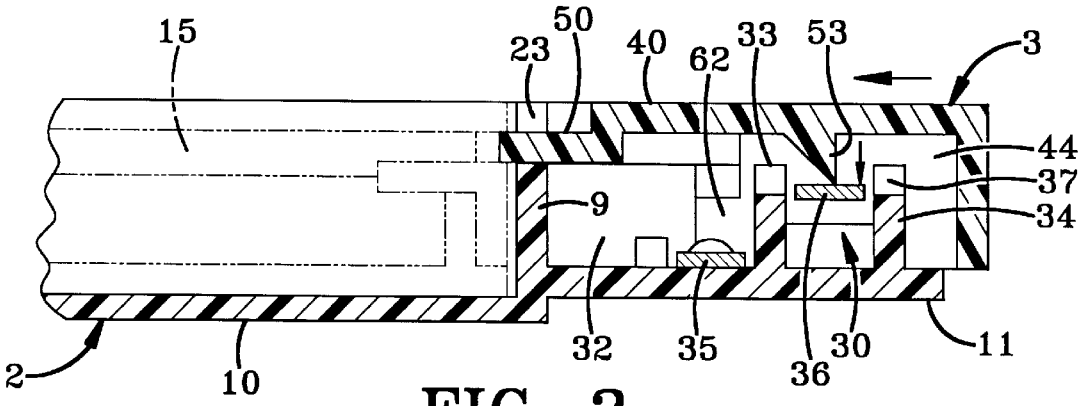
FIG. 3 is an enlarged fragmentary sectional view similar to FIG. 1 with the lock plate partially inserted into the housing but not locked.
Figure 5:
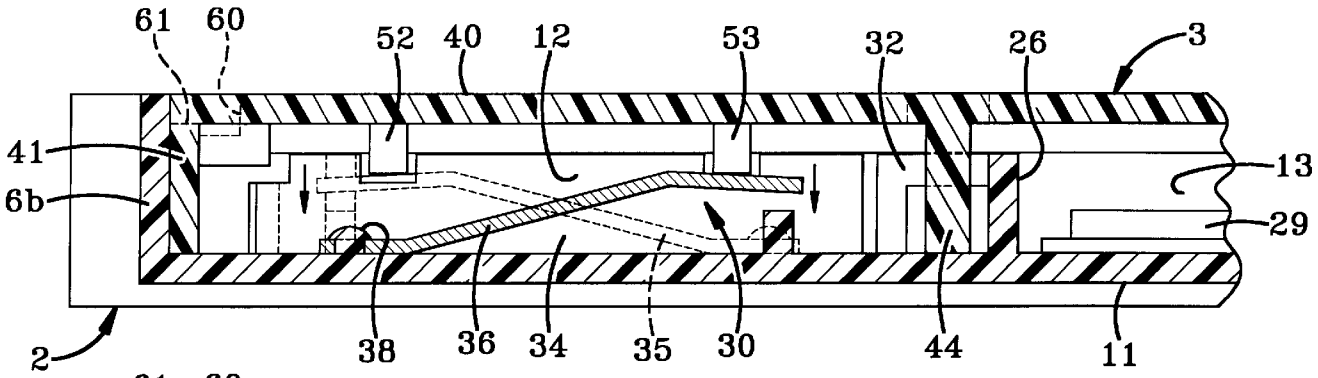
FIG. 5 is a transverse sectional view taken on line 5—5 of FIG. 2 when the lock plate is partially inserted into the housing as shown in FIG. 3.

Lock plate 3 includes a pair of tabs 50 and 51 extending substantially planarly from and outwardly of front wall 40, and in an aligned manner with notches 23 and 24, respectively, when lock plate 3 is aligned with lock compartment 5 as is shown in FIG. 1. On an inner surface of lock plate 3, locking nubs or ramps 52 and 53 extend downwardly from front wall 40 in each of subcompartments 47 and 49, respectively. In each subcompartment 47 and 49, the nubs 52 and 53 are spaced apart in a diagonal manner. This diagonal spacing of nubs 52 and 53 aligns with the terminal end of locking levers 35 and 36 when lock plate 3 is almost, but not completely inserted into lock compartments as is shown in FIGS. 3 and 5.

Lock plate 3 further has molded in grooves 60 in each of the sidewalls 41 and 42 which are correspondingly alignable with planar stops 31 so as to force lock plate 3 under stops 31 and prevent lock plate 3 from being removed from lock compartment 5 by a lifting action such as prying that would increase the distance between back wall 11 and front wall 40. Within grooves or cut-outs 60 are slightly raised surfaces 61 that frictionally fit within planar stops 31. Lock plate 3 further includes a locking tab 62 extending outward from the end of each divider wall 44 and 45 opposed bottom wall 43 where each locking tab 62 is spaced apart from front wall 40 so as to define a slot therebetween. Similar to the function of grooves 60, locking tab 62 engages L-shaped stop 32 thereby prohibiting separation of lock plate 3 by lifting or prying when the distance between back wall 11 and front wall 40 is increased.

In operation, security package 1 provides a reusable security device for preventing unauthorized removal of an article such as a compact disc in a jewel case from a store. Specifically, an article 15 such as a compact disc within a jewel case is inserted into storage compartment 4 by sliding one end of article 15 against end wall 8 so that the article receives tabs 20 and 21 therein, or alternatively slides under tabs 20 and 21. Once article 15 is substantially adjacent end wall 8, article 15 drops completely within storage compartment 4 which is substantially identically sized. At this time, article 15 may be locked within security package 1.

Figure 2:
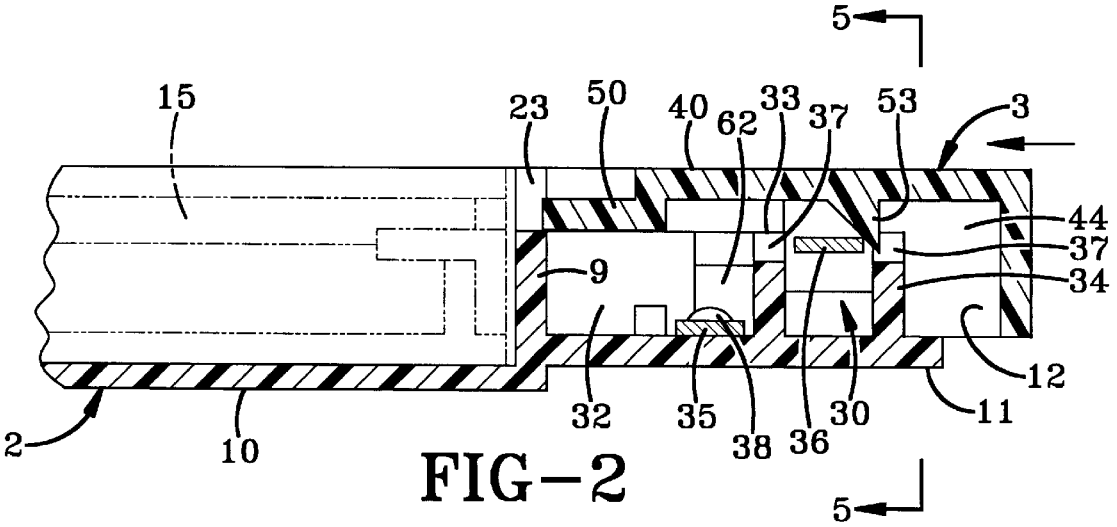
FIG. 2 is an enlarged fragmentary longitudinal section view taken on line 2—2 in FIG. 1 with the lock plate attached to the main housing and in the unlocked position.
Figure 4:
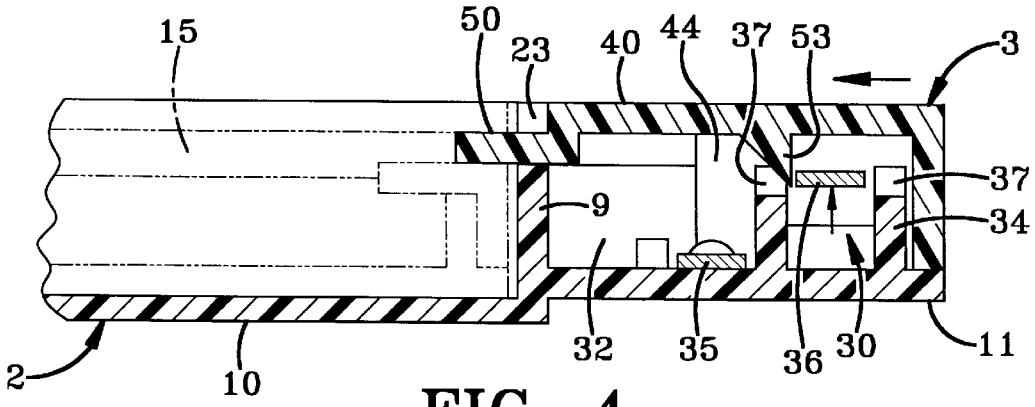
FIG. 4 is an enlarged longitudinal sectional view similar to FIGS. 2 and 3 with the lock plate fully inserted and locked into the housing.

This locking procedure occurs by aligning lock plate 3 with lock compartment 5. Specifically, lock plate 3 is longitudinally aligned below lock compartment 5 as is shown in FIG. 1 and 2 in section. Lock plate 3 is moved longitudinally inward where grooves 60 are aligned with planar stops 31, and locking tabs 62 are aligned with L-shaped stops 32. Further insertion causes groove 60 to slide partially under stop 31 and tab 62 to slip slightly into stop 32 whereby nubs 52 and 53 pass through cut-outs 37 in walls 33 and 34. Such insertion eventually meets a slight resistance as each nub 52 and 53 interacts with and engages the termination end of locking levers 35 and 36 as is shown in FIG. 3. Continued insertion results in slight downward bending of locking levers 35 and 36 away from front wall 40 as is shown by the arrows in FIG. 3. Eventually, nubs 52 and 53 ride over locking levers 35 and 36 thereby allowing locking levers 35 and 36 to rebound or snap back to their original position and rest behind nubs 52 and 53 as is shown in FIG. 4. Once this has occurred, lock plate 3 is no longer removable from lock compartment 5 and housing 2. The result is the insertion of tabs 50 and 51 through notches 23 and 24 and into storage compartment 4 thereby blocking removal of article 15 from within storage compartment 4 by engaging article 15 similar to engagement by tabs 20–21 at the other end of the article. At this time, grooves 60 are fully inserted under stops 31, and locking tabs 62 on divider walls 44 and 45 are inserted under L-shaped stops 32 such that lock plate 3 is not removable by increasing the distance between lock plate 3 and back wall 11. Thus walls 7*a*, 7*b* and 11 on the housing 2 and walls 40, 41 and 42 on the lock plate form a tight box deplete of lips or other areas for prying package 1 apart.

Figure 6:
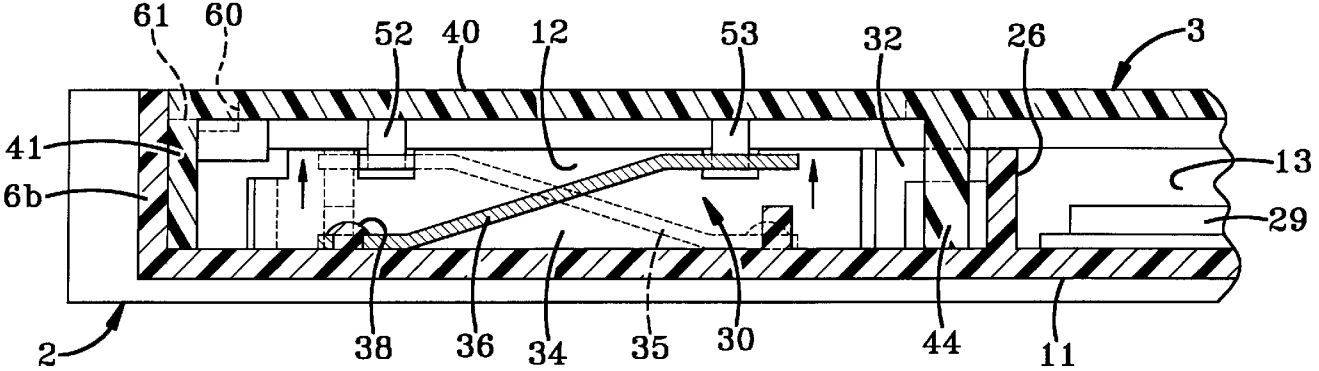
FIG. 6 is a transverse sectional view similar to FIG. 5 when the lock plate is fully inserted and locked into the housing as shown in FIG. 4.

This locking where the nubs 52 and 53 ride over locking levers 35 and 36 is clearly shown in FIGS. 5 and 6. In FIG. 5 the nubs 52 and 53 are bending each of the locking levers 35 and 36 downward. In contrast, in FIG. 6 the nubs have already passed the locking levers 35 and 36 and thereby allowed their return to their standard position which blocks removal of lock plate 3.

Figure 7:
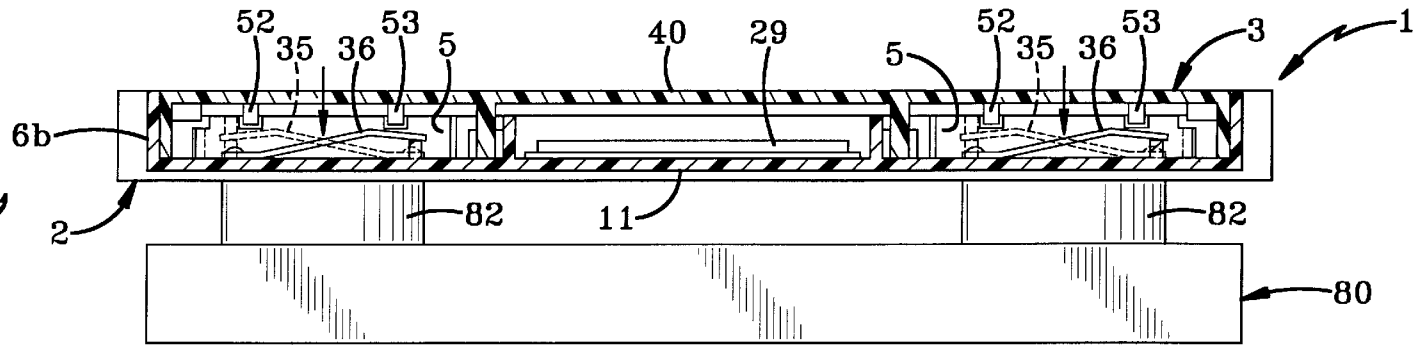
FIG. 7 is a transverse sectional view similar to FIG. 5 showing a magnetic key unlocking the security package.

When it is desirable to remove article 15 from security package 1, such as at point-of-sale, a magnetic key 80, such as is shown in FIG. 7, is used. Key 80 includes a plurality, in this case, two outwardly extending magnets or magnetic surfaces 82. Each of these magnets 82 is correspondingly positioned on key 80 so as to align with the general area in lock compartment 5 where levers 35 and 36 are located. In operation, magnets 82 are positioned adjacent to levers 35 and 36 along back wall 11 as is shown in FIG. 7. When the magnets 82 are sufficiently close, each lever 35 and 36 is magnetically attracted thereby bending or flexing away from the nubs 52 and 53 to a position such as shown in FIG. 7, thereby allowing housing 2 to be removed from lock plate 3. Once housing 2 is removed from lock plate 3, tabs 50 and 51 no longer block article 15 from being removed from storage compartment 4 via the access opening. Security package 1 is then reusable on another article as desired.

If desired, security package 1 may use a top wall or flange extending between walls 6*a* and 7*a* adjacent wall 8 replacing tabs 20 and 21, and a front edge of lock plate 3 could extend over a portion of storage compartment 4 to secure article 15 therein replacing tabs 50 and 51 as shown in the drawings and described above without effecting the concept of the invention.

Figure 8:
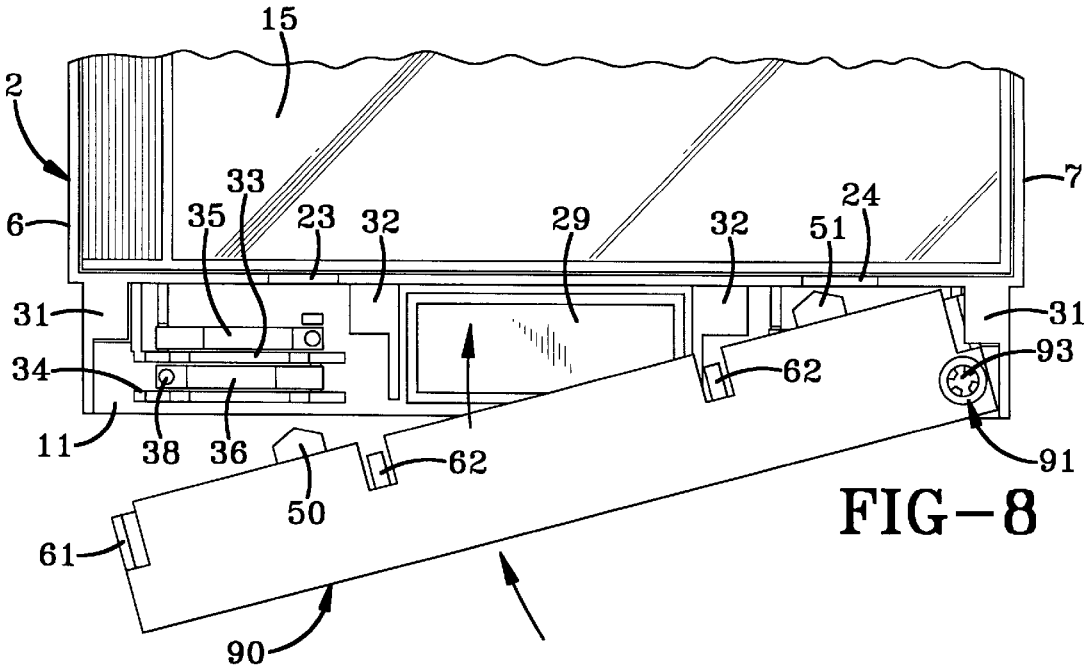
FIG. 8 is a fragmentary top plan view showing a modified embodiment of the present invention in which the lock plate is pivotally mounted on the housing and is shown in partial open position.
Figure 9:
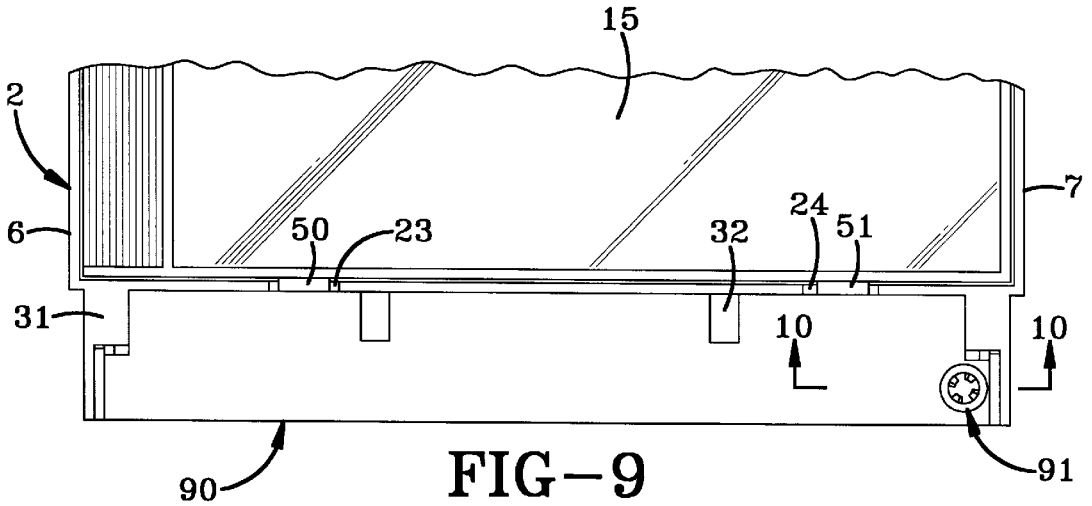
FIG. 9 is a fragmentary top plan view similar to FIG. 8 showing the lock plate in locked position.
Figure 10:
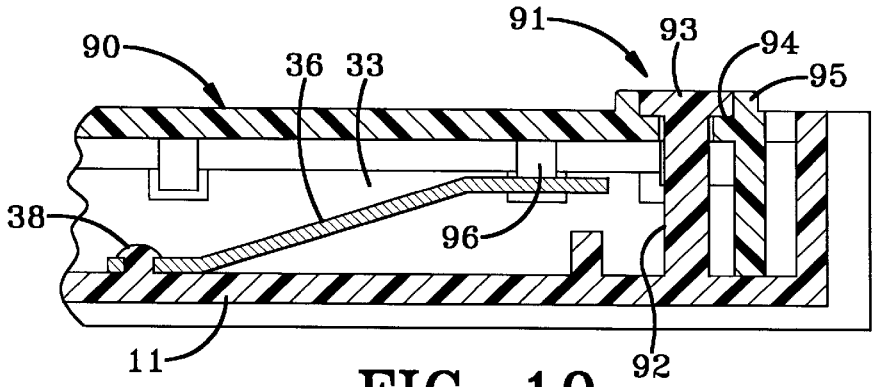
FIG. 10 is an enlarged fragmentary sectional view taken on line 10—10, FIG. 9.

A modified embodiment of the security package is shown in FIGS. 8–10 and is similar to package 1 in most details with the main difference being that a lock plate 90 is pivotally mounted with respect to lock compartment 5 by a pivot mechanism indicated generally at 91. Pivot mechanism 91 includes a pivot post 92 which preferably is molded integrally with wall 11 and extends upwardly therefrom and terminates in a pivot cap 93 which is snapped fitted within a complementary-shaped annular recess 94 formed in plate 90 by an annular boss 95.

As shown in FIGS. 8 and 9, the operation of the modified lock plate 90 is similar to that described above with respect to slide locking plate 3 except it is pivotally moved into a locking position as shown in FIG. 9, wherein the metallic resilient locking levers 35 and 36 engage nubs 96 which are formed on and extend downwardly from the bottom surface of plate 90, for securing lock plate 90 in the locked position until the locking levers are deflected to an unlocked position by the unlocking magnets as shown in FIG. 7.

Figure 11:
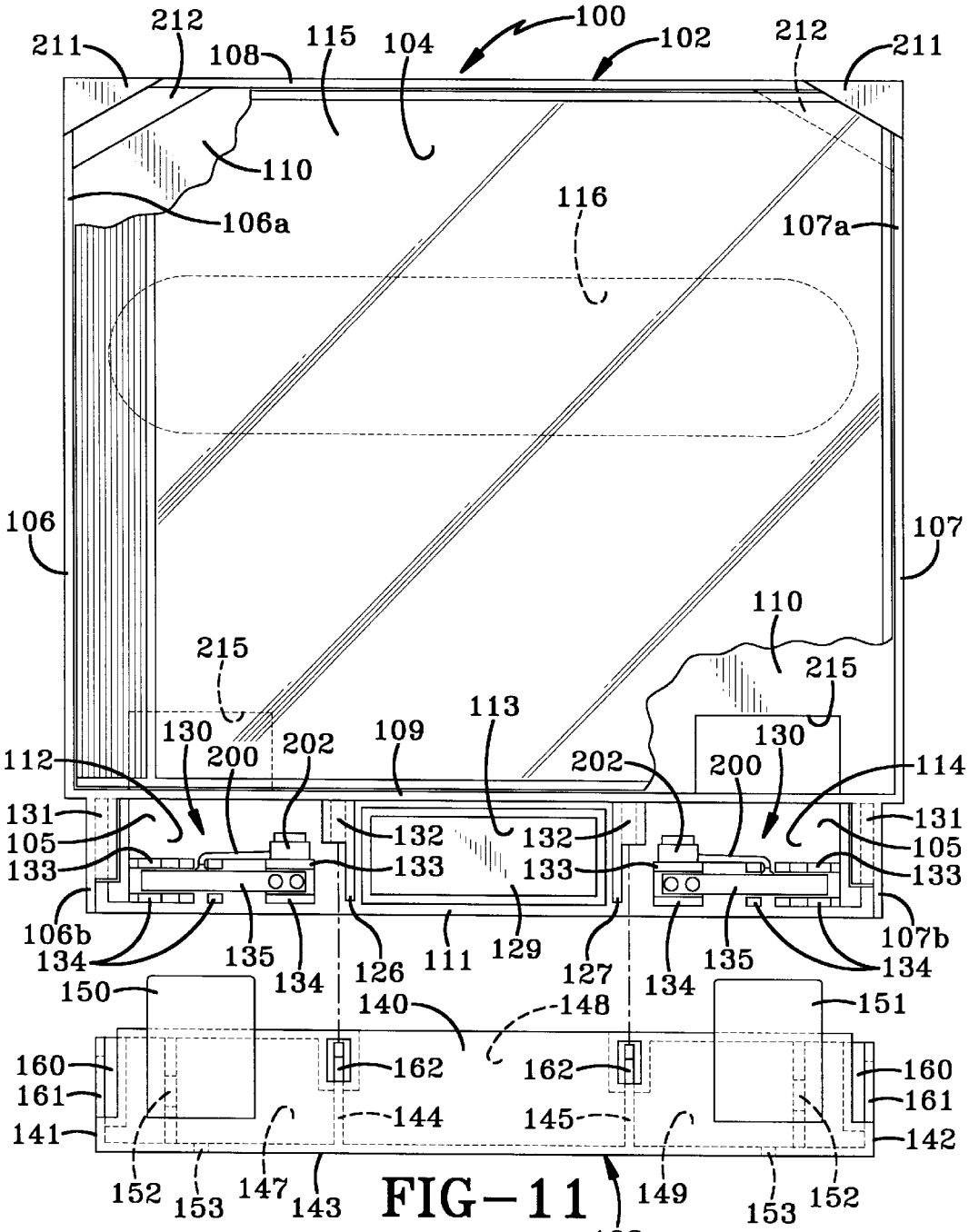
FIG. 11 is a top plan view similar to FIG. 1 of a modified security package with the locking lock plate removed therefrom.

An alternative embodiment of the security package of the present invention is indicated generally at 100 and is shown particularly in FIG. 11. Security package 100 includes a main housing 102 and a slide or lock plate 103, where both housing 102 and lock plate 103 are each preferably formed as an integral one-piece plastic member, preferably of a high-impact polystyrene.

Security package 100 has a generally rectangular configuration with a generally slim depth substantially equivalent to that of a compact disc jewel case. The generally rectangular configuration of security package 100 is defined by a large storage compartment 104 and a small lock compartment 105. Overall, housing 102 includes a pair of longitudinally extending sidewalls 106 and 107 of a stepped construction which extend throughout the longitudinal length of housing 102, a pair of substantially parallel end walls 108 and 109 which extend between and are perpendicular to sidewalls 106 and 107, and a pair of back walls 110 and 111.

Storage compartment 104 is formed by storage sidewalls 106*a* and 107*a*, end walls 108 and 109, and back wall 110. This results in compartment 104 having four sides and a back face thereby providing a space in which a rectangular-shaped article 115, such as a jewel box containing a compact disc, may be placed for storage through an open side or access opening opposite the back face which is wall 110. Wall 110 may further include one or more openings 116 preferably of smaller length and width than wall 110 and spaced inwardly from each of walls 106*a*, 107*a*, 108, and 109 whereby opening 116 is provided so as to supply access to a back side of article 115 for more efficient removal of article 115 when lock plate 103 is not in the locked position as described below and to view graphics located in the jewel box.

Lock compartment 105 is formed by sidewalls 106*b* and 107*b*, end wall 109 and a back wall 111. Lock compartment 105 is divided into three subcompartments 112,113, and 114 by divider walls 126 and 127. Subcompartment 113 includes an electronic article surveillance (EAS) tag 129, while subcompartments 112 and 114 include a locking mechanism 130. Subcompartments 112 and 114 each include pry stops formed as a planar stop 131 that is parallel to back wall 111 and spaced apart therefrom, and is integrally molded into sidewalls 106*b* and 107*b*, respectively. End wall 109, subcompartments 112 and 114 further include a stop 132 that is L-shaped with a portion parallel to back wall 111 that extends out from end wall 109 and divider walls 126 and 127, respectively, and is connected by a perpendicular portion to back wall 111 that extends from the parallel portion to back wall 111 and outward from end wall 109.

Each locking mechanism 130 includes a pair of spaced access restriction walls 133 and 134 extending perpendicularly upward from back wall 111. Access restriction walls 133 and 134 extend transversely between one of locked sidewalls 106*b* and 107*b* and one of divider walls 126 and 127 within each of subcompartments 112 and 114. Each access restriction wall 133 and 134 includes three cut-outs 137, 138, and 139 for use during interaction of lock plate 103 with storage compartment 104. In accordance with one of the features of the invention, each locking mechanism 130 includes a first locking member in the form of a metallic, resilient locking lever 135 that obliquely extends upwardly from back wall 111 in each subcompartment 112 and 114.

Figure 19:
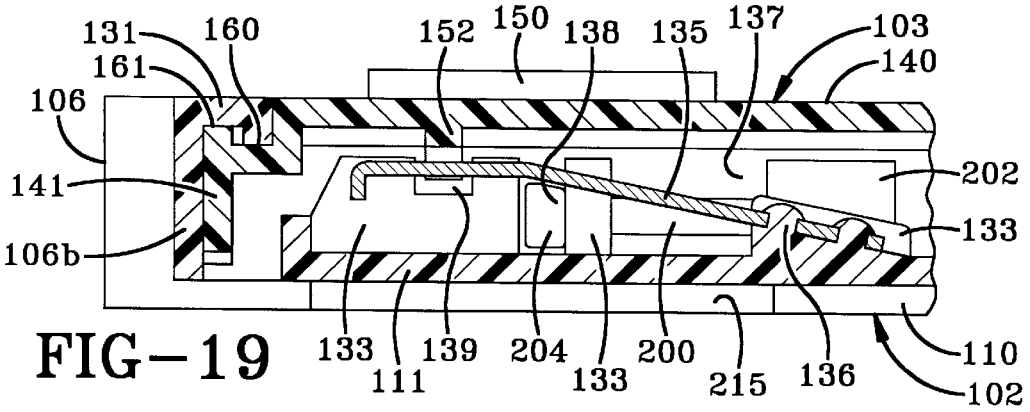
FIG. 19 is a fragmentary sectional view of the left hand corner of FIG. 11 with the lock plate mounted thereon and shown in locked position.
Figure 20:
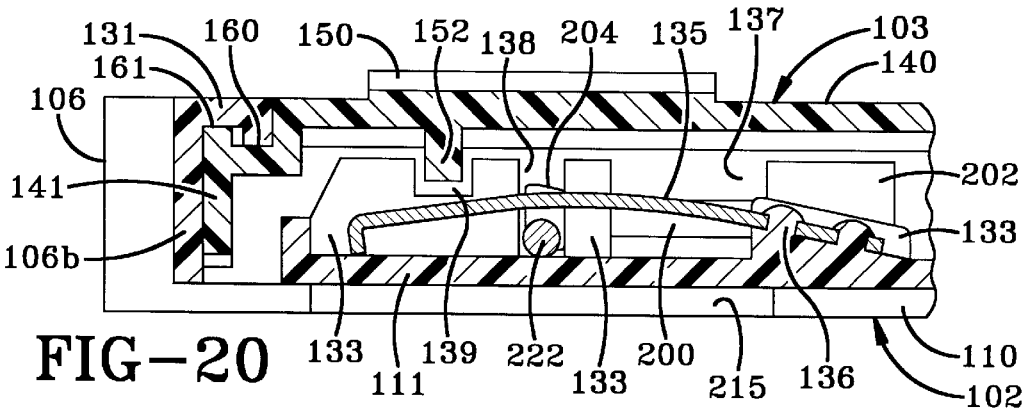
FIG. 20 is a fragmentary sectional view similar to FIG. 19 showing the lock plate in an unlocked position when engaged by the key of FIG. 13.

Each resilient locking lever 135 is substantially disposed between access restriction walls 133 and 134 in each subcompartment 112 and 114. Each of the levers 135 are affixed to back wall 111 by any type of fastener or fastening means 136 which could be an adhesive, rivet, or any other device and/or method of fastening. The slope of each lever 135 may be constant or, as shown in FIGS. 19 and 20, may include a flat region disposed between an upwardly sloping region and a substantially vertical region. The changes in slope between the regions may be gradual or at substantially distinct points as shown in the Figures.

Each locking lever 135 is fabricated from a metallic material susceptible to magnetic attraction and repulsion. Each of the locking levers 135 is disposed so as to have a resting or natural position, which is also the lock position as shown in FIG. 19, where the connection is substantially parallel to back wall 111. Each of locking levers 135 is flexible so as to flex out of the lock position when subjected to a magnetic force and resilient so as to return to the lock position when the magnetic force is removed. The lock position is depicted in FIG. 19 while the released or unlocked position is depicted in FIG. 20 where lever 135 is subjected to a magnetic force that is attracting lever 135 toward back wall 111.

Figure 15:
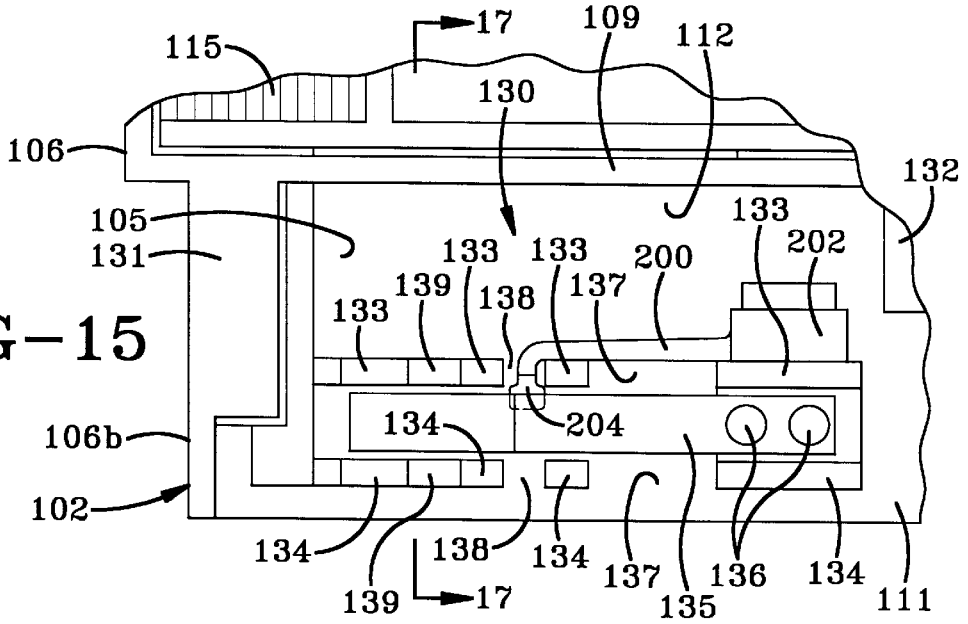
FIG. 15 is a greatly enlarged fragmentary plan view of the left hand end of FIG. 11 with the lock plate shown in locked position.
Figure 17:
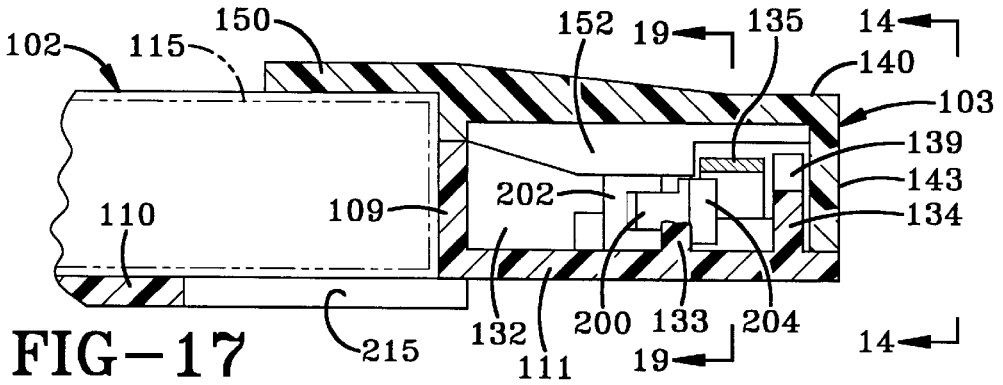
FIG. 17 is a fragmentary sectional view taken along line 17—17 of FIG. 15.

Each locking mechanism 130 further includes a second lock member 200 in the form of a resilient blocking arm. Resilient arm 200 extends from a base 202 that is connected to back wall 111. A blocking head 204 is connected to the end of arm 200 opposite base 202. Blocking head 204 is disposed in cut-out 138 of access restriction wall 133 when resilient arm 200 is in its locked position as depicted in FIGS. 15, 17, and 19. Locking lever 135 cannot be deflected out of the resting position with blocking head 204 in its resting or blocking position. As such, resilient arm 200 and blocking head 204 provide a safety mechanism to locking mechanism 130 preventing locking lever 135 from unintentionally unlocking as a result of a shock force.

Figure 12:
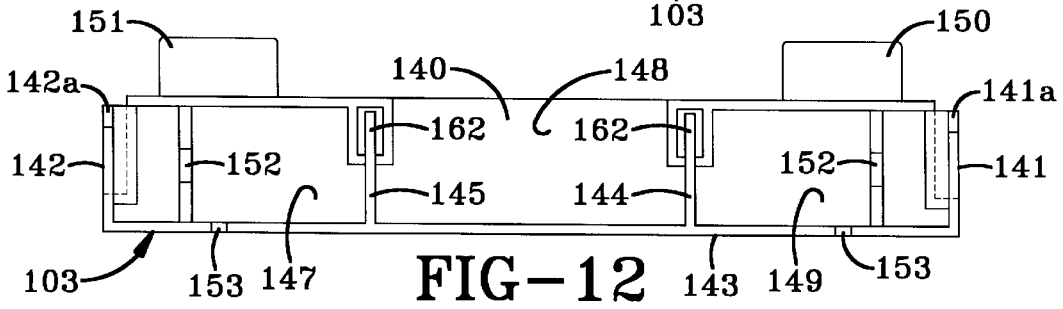
FIG. 12 is a bottom plan view of the locking lock plate of FIG. 11.

Lock plate 103 as is shown in FIG. 11 has a front wall 140 terminating at opposing sides in sidewalls 141 and 142 and along a bottom edge in bottom wall 143. A pair of divider walls 144 and 145 extend from front wall 140 in a spaced-apart and parallel manner between sidewalls 141 and 142 so as to divide lock plate 103 into three subcompartments 147, 148, and 149 of similar dimension to subcompartments 112–114 of compartment 105. As may be seen in FIGS. 12 and 21, each sidewall 141 and 142 includes a lip 141*a* and 142 a that engages back wall 111 to prevent lock plate 103 from becoming separated from housing 102.

Lock plate 103 further has molded in grooves 160 in each of sidewalls 141 and 142 which are correspondingly alignable with planar stops 131 so as to force lock plate 103 under stops 131 and prevent lock plate 103 from being removed from lock compartment 105 by a lifting action such as prying that would increase the distance between back wall 111 and front wall 140. Within grooves or cut-outs 160 are slightly raised surfaces 161 that frictionally fit within planar stops 131. Lock plate 103 further includes a locking tab 162 extending outward from the end of each divider wall 144 and 145 opposite bottom wall 143 where each locking tab 162 is spaced apart from front wall 140 so as to define a slot therebetween. Similar to the function of grooves 160, locking tab 162 engages L-shaped stop 132 thereby prohibiting separation of lock plate 103 by lifting or prying when the distance between back wall 111 and front wall 140 is increased.

Lock plate 103 further includes a pair of tabs 150 and 151 that extend upwardly from front wall 140 and protrude over article 115 in storage compartment 104 when lock plate 103 is in the locked position as depicted in FIGS. 13, 17, 22, and 23. Tabs 150 and 151 prevent article 115 from being removed from storage compartment 104 when lock plate 103 is in the locked position.

Lock plate 103 further includes a pair of locking ramps 152 that extend downwardly from the inner surface of front wall 140 in each of compartments 147 and 149. Locking ramps 152 are disposed to be received in cut-outs 139 of access restriction walls 133 and 134 when lock plate 103 engages lock compartments 105. Lock plate 103 further includes a pair of key holes 153 formed in bottom wall 143. Each key hole 153 is disposed to align with cut-outs 138 of access restriction walls 133 and 134. Key holes 153 are thus also aligned with blocking heads 204 of resilient arms 200.

Figure 22:
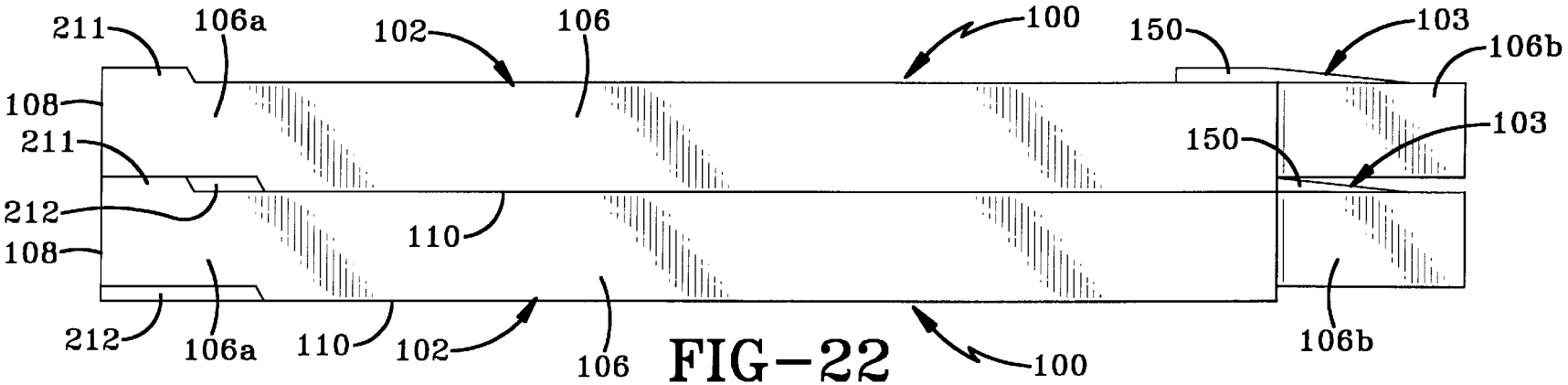
FIG. 22 is a side elevational view of a pair of the security packages of FIG. 11 in a nested stacked relationship and in a locked position.
Figure 23:
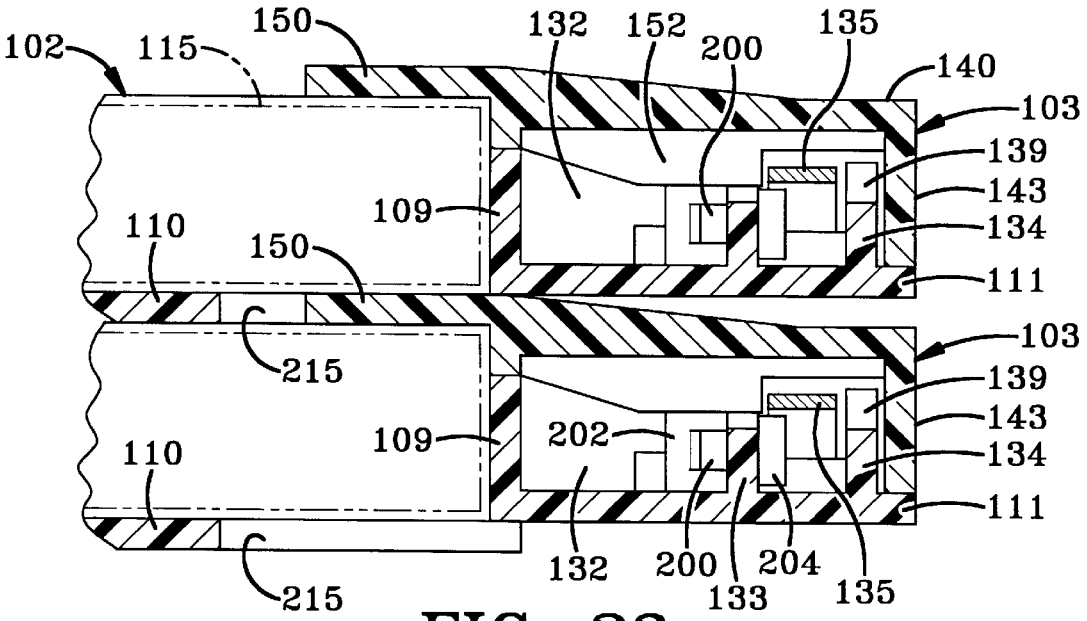
FIG. 23 is an enlarged fragmentary sectional view of the right hand end of FIG. 22.
Figure 24:
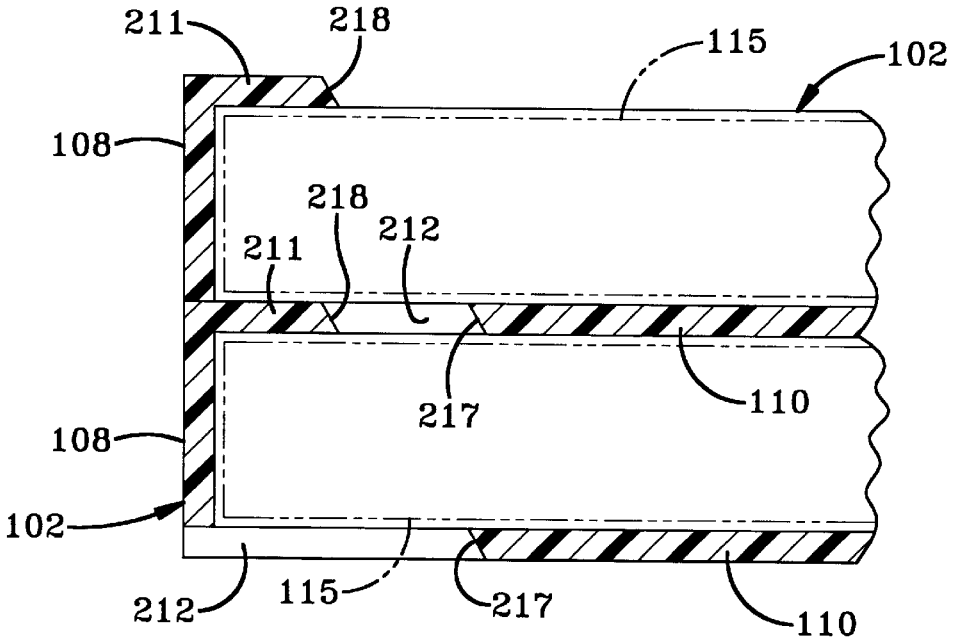
FIG. 24 is an enlarged fragmentary sectional view of the left hand end of FIG. 22.

One of the unique features achieved by security package 100 is its stackability wherein adjacent packages 100 are nested together to reduce storage and shipping space as shown particularly in FIGS. 22 through 24. This nestability is achieved by corner cutouts 212 aligning with flanges 211 as shown in FIGS. 22 and 24. Likewise, locking tabs 150 and 151 extend into rectangle shaped cutouts 215 as shown in FIG. 23 to provide this nestability of the adjacent security packages 100. Thus, as shown in FIGS. 22–24, the overall thickness is not materially increased due to the nesting of flanges 211,150, and 151 in cutouts 212 and 215 of an adjacent security package 100. Cutouts 212 and 215 are configured to allow adjacent packages 100 to tilt with respect to each other while being nested together because cutouts 212 and 215 are substantially larger than flanges 211 and locking tabs 150 and 151. A nested package 100 may be easily removed even when in a nested condition because locking tabs 150 and 151 are ramped or angled upwardly from lock plate 103 as shown in FIG. 23. Lower surface 217 of cutouts 212 may also be angled to facilitate removal of a nested package 100 as shown in FIG. 24. Lower surface 218 of flanges 211 may also be angled for the same reason.

In operation, security package 100 provides a reusable security device for preventing unauthorized removal of an article such as a compact disc in a jewel case from a store. Specifically, an article 115 such as a compact disc within a jewel case is inserted into storage compartment 104 by sliding one end of article 115 against end wall 108 so that article 115 slides under flanges 211. Once article 115 is substantially adjacent end wall 108 article 115 drops completely within storage compartment 104 which is substantially identically sized. At this time, article 115 may be locked within security package 100.

Figure 21:
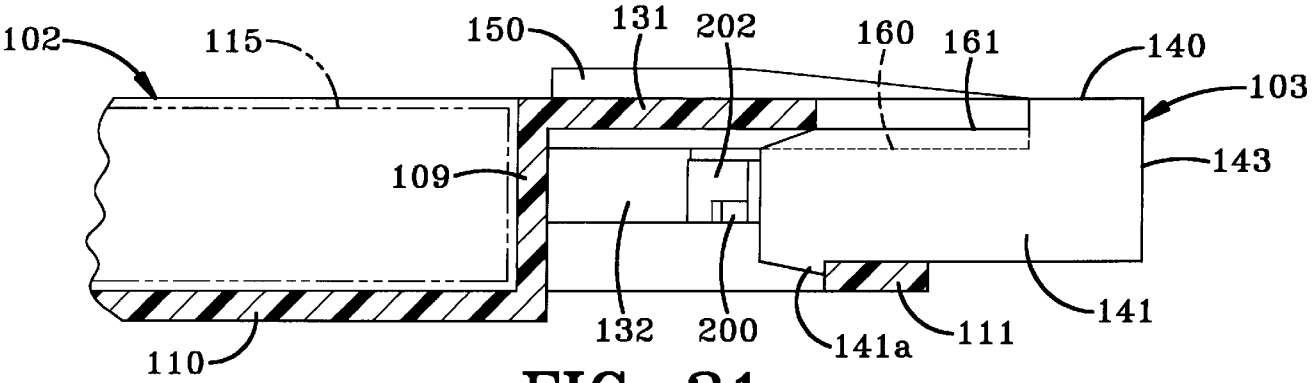
FIG. 21 is a fragmentary sectional view taken along line 21—21 of FIG. 14 but showing the lock plate in an unlocked position.

This locking procedure occurs by aligning lock plate 103 with lock compartment 105. Specifically, lock plate 103 is longitudinally aligned below lock compartment 105 as is shown in FIGS. 11 and 21. Lock plate 103 is moved longitudinally inward where grooves 160 are aligned with planar stops 131, and locking tabs 162 are aligned with L-shaped stops 132. Further insertion causes groove 160 to slide partially under stop 131 and tabs 162 to slip slightly into stop 132 whereby locking ramps 152 pass through cut-outs 139 in walls 133 and 134. Such insertion eventually meets a slight resistance as each locking ramp interacts with and engages the locking levers 135. Continued insertion results in slight downward bending of locking levers 135 away from front wall 140. Eventually, locking ramps 152 ride over locking levers 135 thereby allowing locking levers 135 to rebound or snap back to their original position and rest behind locking ramp 152 as is depicted in FIGS. 17, 19, and 23. Once this has occurred, lock plate 103 is no longer removable from lock compartment 105 and housing 102. ramps 152 engage levers 135 to prevent lock plate 103 from being moved back out of engagement with housing.

The result is the placement of locking tabs 150 and 151 over storage compartment 104 thereby locking article 115 within storage compartment 104. At this time, grooves 160 are fully inserted under stops 131 and locking tabs 162 on divider walls 144 and 145 are inserted under L-shaped stops 132 such that lock plate 103 is not removable by increasing the distance between lock plate 103 and back wall 111. Thus, walls 106*b*, 107*b*, and 111 on housing 102 and walls 140, 141, and 142 on lock plate 103 form a tight box deplete of lips or other areas for prying package 100 apart.

Figure 13:
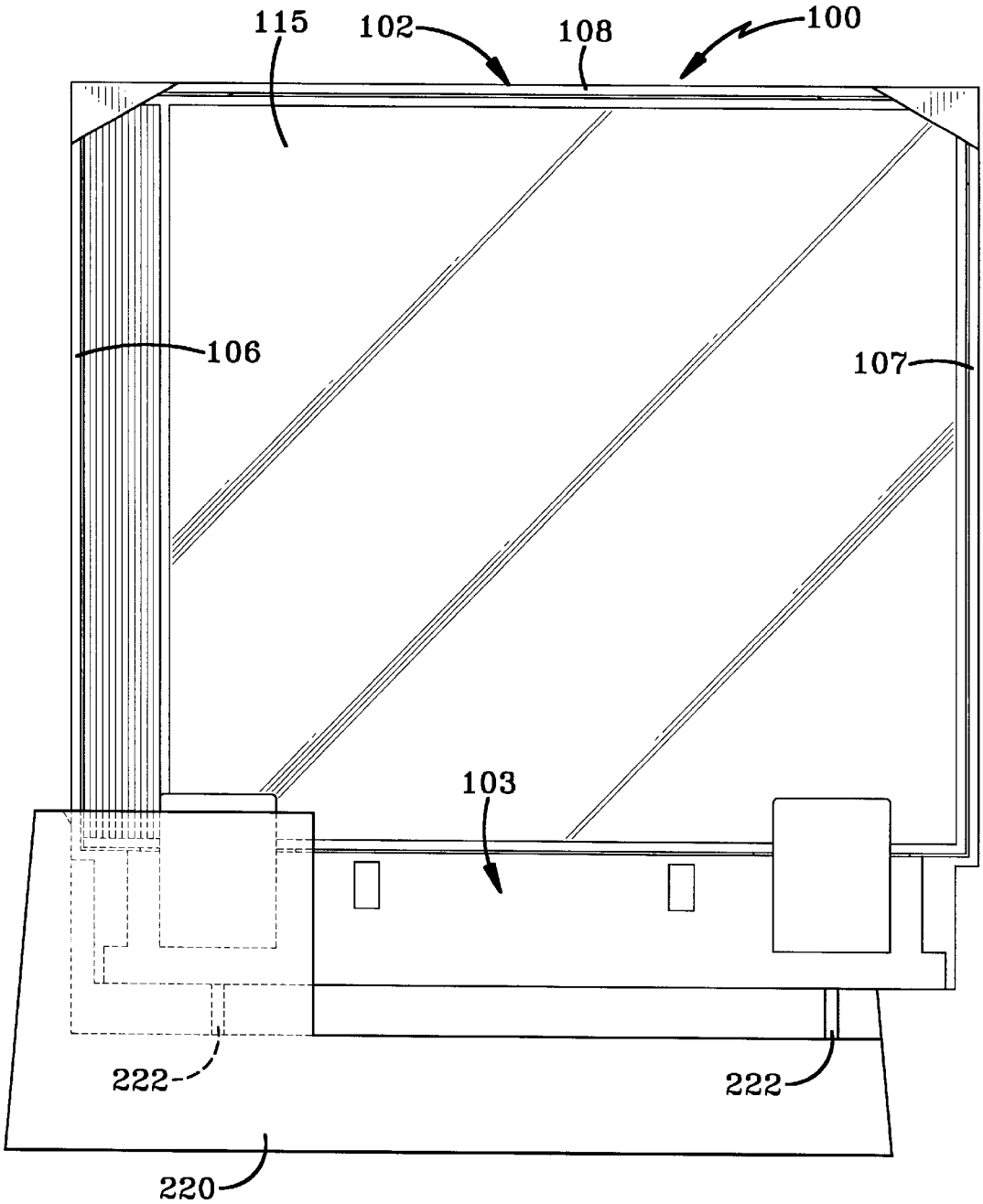
FIG. 13 is a side elevational view showing the security package of FIG. 11 engaged with a release key.
Figure 14:
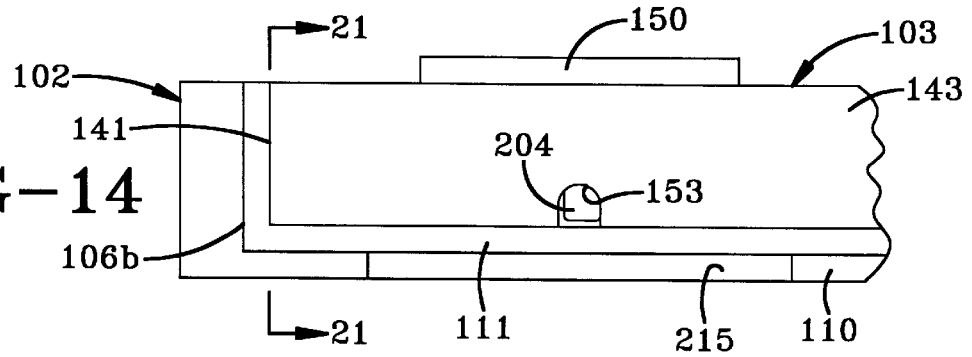
FIG. 14 is a fragmentary elevational view looking in the direction of arrows 14—14 of FIG. 17 including portions of the release key of FIG. 13.
Figure 16:
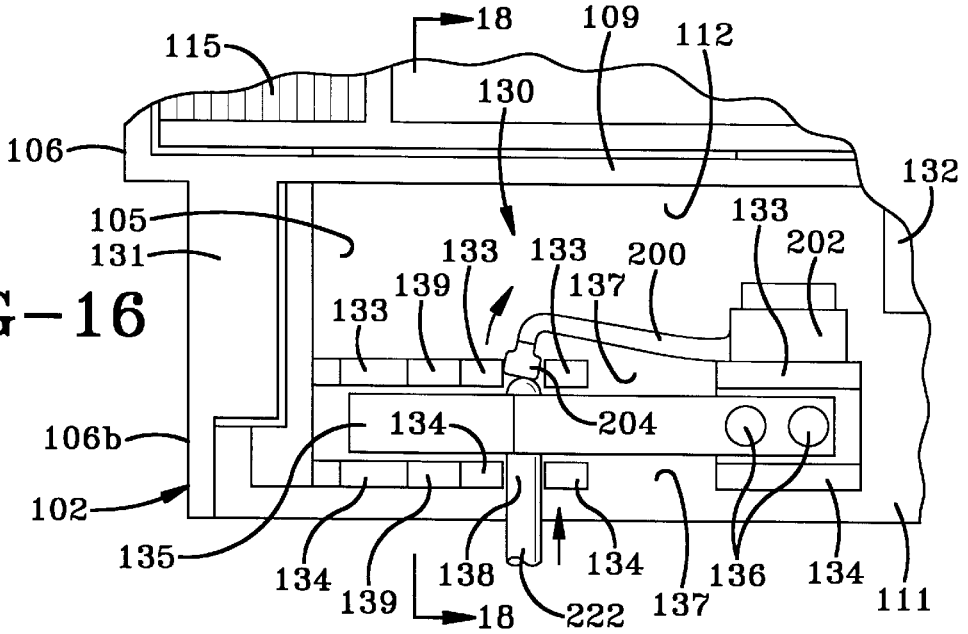
FIG. 16 is a view similar to FIG. 15 showing movement of the lock mechanism into the unlocked position.
Figure 18:
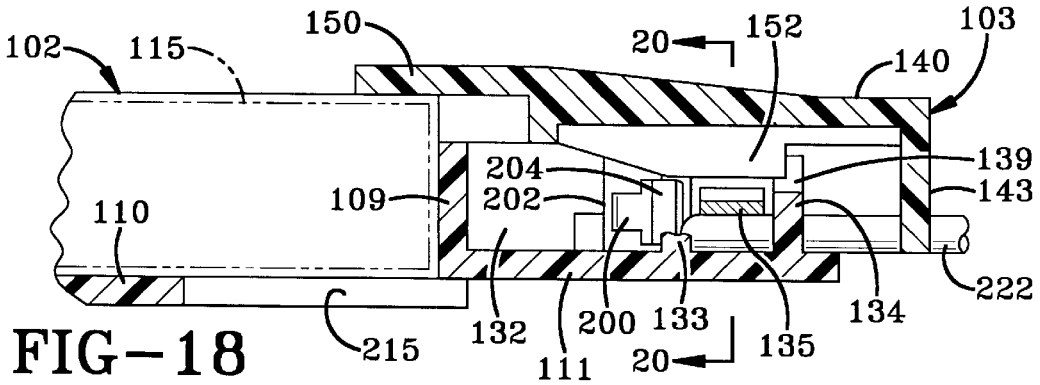
FIG. 18 is a fragmentary sectional view taken along line 18—18 of FIG. 16.

When it is desired to remove article 115 from security package 100, such as at point-of-sale, a key 220, such as shown in FIG. 13, is used. Key 220 includes a plurality, in this case, two outwardly extending magnets or magnetic surfaces. Each of these magnets is correspondingly positioned on key 220 so as to align with the general area in lock compartment 105 where levers 135 are located. Key 220 includes a pair of key rods 222 that are disposed to slidably enter key holes 153 when locked security package 100 is placed in key 220. In operation, key rods 222 are inserted into key holes 153 and slide into cut-outs 138 of walls 133 and 134. Locked security package 100 is then pressed downwardly into key 220 until key rods 222 engage blocking heads 204 as is shown in FIG. 16. Key rods 222 continue to move inwardly forcing resilient arm 200 to flex to an unblocking position as depicted in FIGS. 16,18, and 20. Once blocking heads 204 are moved out from under levers 135, the magnets in key 220 attract levers 135 towards back wall 111 to urge them into the unlocked position depicted in FIGS. 16, 18, and 20. Levers 135 are not stopped by key rods 222 because the diameter of key rod 222 is approximately half of the height of blocking head 204. Key holes 153 are also disposed adjacent wall 111 so as to position key rods 222 as far below locking levers 135 as possible.

Once levers 135 are magnetically attracted to the magnets in key 220 and blocking heads 204 are in the unblocking positions, lock plate 103 may be moved to its unlocked position from housing 102. Lock plate 103 is moved sufficiently as that tabs 150 and 151 no longer block article 115 from being removed from storage compartment 104 via the access opening. Security package 100 is then reusable on another article as desired.

Accordingly, the improved security package is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved security package is constructed and used, the characteristics of the construction, and the advantageous, new and useful results obtained; the new and useful structures, devices, elements, arrangements, parts and combinations, are set forth in the appended claims.

We claim:

1. A security package for holding and displaying an article comprising:

a housing having a storage compartment for selectively storing the article, said compartment having an access opening for inserting and removing the article into and out of said compartment;

a lock compartment formed in said housing adjacent said storage compartment;

a lock plate movably mountable with respect to said lock compartment and selectively movable across at least a portion of said access opening of said storage compartment between locked and unlocked positions for releasably securing said article in said storage compartment; and first and second lock members within said lock compartment that cooperate to operatively engage with said lock plate for selectively securing said lock plate in said locked position and releasing said lock plate from said locked position, said first lock member being moveable between a blocking position and an unblocking position by an external actuator enabling said second lock member to release said lock plate when said second lock member is proximate a magnetic field.

2. The security package of claim 1 further comprising an electronic article surveillance tag carried by said housing.

3. The security package of claim 1 wherein said first lock member is an arm that is movable between the blocking and unblocking positions.

4. The security package of claim 3 wherein said second lock member is includes at least one deflectable lever movable between locked and unlocked positions.

5. The security package of claim 4 wherein said movable arm of the first lock member is resilient and is disposed between a back wall of the lock compartment and said deflectable lever when said arm and said deflectable lever are disposed in said blocking and unlocking positions, respectively.

6. The security package of claim 4 wherein said deflectable lever is a flexible, magnetically influenceable lever affixed within said lock compartment and biased away from a back wall of said compartment.

7. The security package of claim 6 wherein said deflectable lever is urged toward the back wall of the housing by a magnetic field when said blocking arm is moved toward the unlocked position.

8. The security package of claim 1 wherein said lock plate has a pair of locking ramps that engage a pair of said second lock members when said lock plate is in the locked position.

9. The security package of claim 3 in combination with a magnetic key having a key rod interactable with said arm of the first locking member for moving said arm to the unblocking position.

10. The security package of claim 1 wherein said lock plate includes a pair of locking tabs that extend over a portion of said storage compartment when said lock plate is in the locked position.

11. The security package of claim 10 wherein said housing has a back wall formed with a pair of cutouts adapted to receive locking tabs of a lock plate of an adjacent security package when said security packages are in a nested relationship.

12. The security package of claim 11 wherein said housing further includes a pair of corner flanges that extend between pairs of corners of said storage compartment and a pair of cutouts in a back wall of the housing and spaced from said flanges for receiving the corner flanges of an adjacent security package when said security packages are in a nested relationship.

13. In combination, a jewel case for holding a compact disc and a security package for holding and displaying said jewel box, said security package including:

a housing having a storage compartment for selectively storing said jewel box, said compartment having an access opening for inserting and removing said jewel box into and out of said compartment;

a lock compartment formed in said housing adjacent said storage compartment;

a lock plate movably mountable with respect to said lock compartment and selectively movable across at least a portion of said access opening of said storage compartment between locked and unlocked positions, said lock plate securing said jewel box in said storage compartment when said lock plate is in said locked position; and first and second lock members within said lock compartment and operatively engageable with said lock plate for selectively securing said lock plate in the locked position and releasing said lock plate from said locked position, said first lock member being moveable between a blocking position and an unblocking position by an external actuator enabling said second lock member to release the lock plate when said second lock member is proximate a magnetic field.

14. The combination of claim 13 wherein said first lock member includes a resilient arm that is movable between a blocking position and an unblocking position.

15. The combination of claim 14 wherein said second lock member includes at least one deflectable lever movable between a locking position and an unlocking positions.

16. The combination of claim 13 wherein said resilient arm extends between the lever and a back wall of the lock compartment to prevent said lever from moving to the unlocking position when said resilient arm is in said blocking position.

17. The combination of claim 16 wherein said lever is a flexible, magnetically influenceable lever affixed to the back wall of the lock compartment and biased away from said wall.

18. The combination of claim 15 further including a key having at least one key rod interactable with the resilient arm of the first lock member for moving said arm to the unblocking position to permit said deflectable lever to move to the unlocked position when proximate a magnet contained in said key.

19. The combination of claim 13 wherein said lock plate includes a pair of locking tabs that extend over said storage compartment when said lock plate is in the locked position.

20. A security package for holding and displaying an article comprising:

a housing having a storage compartment for selectively storing the article, said compartment having an access opening for inserting and removing the article into and out of said compartment;

a lock compartment formed in said housing adjacent said storage compartment;

a lock plate movably mountable with respect to said lock compartment and selectively movable towards and away from said access opening of said storage compartment between locked and unlocked positions for releasably securing said article in said storage compartment;

at least one locking tab extending from said lock plate, said locking tab disposed over at least a portion of said storage compartment when said lock plate is in the locked position;

at least one flange connected to said housing and extending over a portion of said storage compartment;

said base having a back wall formed with a first cutout adapted to receive the flange of an adjacent security package to allow the two security packages to nest together; and said back wall having a second cutout adapted to receive the locking tab of an adjacent security package to allow the two security packages to nest together.

21. The security package of claim 20 wherein said first cutout is substantially larger than said flange to allow nested security packages to tilt with respect to each other and wherein said second cutout is substantially larger than said locking tab to allow said nested security packages to tilt with respect to each other.

22. The security package of claim 20 wherein each locking tab is ramped to allow nested security packages to be easily removed from one another and wherein first cutout has an angled lower surface to allow the adjacent nested flange to easily slide out of first cutout.

23. The security package of claim 20 wherein said flange has an angled lower surface to allow said flange to easily slide out of an adjacent cutout.

* * * * *